US011662087B2

(12) United States Patent
Chai et al.

(10) Patent No.: US 11,662,087 B2
(45) Date of Patent: May 30, 2023

(54) POWER SUPPLY DEVICE AND HIGH-POWER ILLUMINATION SYSTEM

(71) Applicant: Delta Electronics (Shanghai) Co., Ltd., Shanghai (CN)

(72) Inventors: Zhaowei Chai, Shanghai (CN); Xinghua Zhang, Shanghai (CN); Xiaoping Fu, Shanghai (CN); Yong Hu, Shanghai (CN)

(73) Assignee: Delta Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/809,560

(22) Filed: Jun. 29, 2022

(65) Prior Publication Data

US 2023/0019083 A1 Jan. 19, 2023

(30) Foreign Application Priority Data

Jul. 7, 2021 (CN) ..... 202110770804.X

(51) Int. Cl.
*F21V 29/508* (2015.01)
*F21V 29/76* (2015.01)
(Continued)

(52) U.S. Cl.
CPC ..... *F21V 29/508* (2015.01); *F21V 23/023* (2013.01); *F21V 29/76* (2015.01); *F21W 2131/406* (2013.01)

(58) Field of Classification Search
CPC ..... F21V 31/04; F21V 15/01; F21V 23/009; F21V 23/02; F21V 29/507; F21V 29/713; F21V 31/005
See application file for complete search history.

(56) References Cited

U.S. PATENT DOCUMENTS 6,222,732 B1 4/2001 Jakob
2008/0144290 A1 6/2008 Brandt et al.
(Continued)

FOREIGN PATENT DOCUMENTS

CN 2213412 Y 11/1995
CN 101182909 A 5/2008
(Continued)

OTHER PUBLICATIONS

Corresponding China Office Action dated Apr. 28, 2022 with its English translation.

*Primary Examiner* — William J Carter
(74) *Attorney, Agent, or Firm* — CKC & Partners Co., LLC

(57) ABSTRACT

The present disclosure provides a power supply device and a high-power illumination system. The power supply device includes: a housing, where the housing includes a first bottom plate having a first surface on which a first heat sink is provided and a second surface on which a thermal conductive potting layer is provided; and a printed circuit board, where the printed circuit board is located in the housing, the printed circuit board includes a circuit board body and multiple electronic components arranged on the circuit board body, at least part of the multiple electronic components is arranged facing the second surface of the first bottom plate, and the electronic component of the at least part of the multiple electronic components is partially immersed in the thermal conductive potting layer to conduct heat dissipated by the electronic component to the first heat sink for natural heat dissipation of the electronic component.

13 Claims, 9 Drawing Sheets

(51) Int. Cl.
*F21V 23/02* (2006.01)
*F21W 131/406* (2006.01)

(56) References Cited

U.S. PATENT DOCUMENTS

| | | | | |
|---|---|---|---|---|
| 2014/0369004 | A1 | 12/2014 | Yoshizumi et al. | |
| 2015/0013956 | A1 | 1/2015 | Yoshizumi et al. | |
| 2016/0084483 | A1* | 3/2016 | Dubuc | F21V 29/89 29/458 |
| 2019/0203922 | A1* | 7/2019 | Bendtsen | G01J 1/4228 |

FOREIGN PATENT DOCUMENTS

| | | | |
|---|---|---|---|
| CN | 101541155 | A | 9/2009 |
| CN | 101930951 | A | 12/2010 |
| CN | 202918629 | U | 5/2013 |
| CN | 203500973 | U | 3/2014 |
| CN | 104302160 | A | 1/2015 |
| CN | 104747928 | A | 7/2015 |
| CN | 204539684 | U | 8/2015 |
| CN | 205611150 | U | 9/2016 |
| CN | 103296863 | B | 3/2017 |
| CN | 206713184 | U | 12/2017 |
| CN | 207118193 | U | 3/2018 |
| CN | 207179272 | U | 4/2018 |
| JP | 2005093582 | A | 4/2005 |
| JP | 2007097296 | A | 4/2007 |

* cited by examiner

POWER SUPPLY DEVICE AND HIGH-POWER ILLUMINATION SYSTEM

CROSS-REFERENCE TO RELATED APPLICATION

This application claims priority to Chinese Patent Application No. 202110770804.X, filed on Jul. 7, 2021, the disclosure of which is hereby incorporated by reference in its entirety.

TECHNICAL FIELD

The present disclosure relates to illumination technology and, in particular, to a power supply device and a high-power illumination system.

BACKGROUND

In some outdoors environments such as stadiums and squares, etc., high power supplies in illumination devices have been widely used. With increment in power of power supplies, outdoor high power supplies are required to not only meet climate resistance requirements, but also to meet increasingly higher heat dissipation requirements. Due to limitation of application conditions, such power supplies are difficult to use fluid heat dissipation and forced heat dissipation, but can only rely on natural heat dissipation. The natural heat dissipation is achieved by using a thermally conductive material to transfer heat from a heat source inside a power supply to the housing of the power supply, and dissipating the heat to the outside air through natural convection. The heat source inside the power supply is mainly an electronic component installed on a circuit board.

For the natural heat dissipation in the prior art, a thermal pad is generally provided between an electronic component and a housing so that heat from the electronic component is transferred to the housing through the thermal pad to achieve heat conduction. However, when such heat conduction approach is applied to a high power supply, a large number of thermal pads are required, resulting in an increase in material costs of the product. Meanwhile, it is not easy to fix the thermal pads during assembling, and the thermal pads are easy to misplace and miss. In addition, when designer considers directly heat dissipation for a specific electronic component with an irregular shape inside the power supply, an additional cooling tank is generally provided on a bottom plate of the power supply for local potting. Once a size or layout of the specific electronic component on the circuit board changes, the housing of the power supply also changes accordingly. Therefore, it is difficult to unify model, which further leads to an increase in mold costs and processing costs of the product.

SUMMARY

The present disclosure provides a power supply device and a high-power illumination system to solve the technical problem that the existing power supply device has high costs in terms of its heat dissipation structure and the thermal pad are easy to misplace and miss.

The present disclosure provides a power supply device, including: a housing, where the housing includes a first bottom plate having a first surface on which a first heat sink is provided and a second surface on which a thermal conductive potting layer is provided; and a printed circuit board, where the printed circuit board is located in the housing, the printed circuit board includes a circuit board body and multiple electronic components arranged on the circuit board body, at least part of the multiple electronic components is arranged facing the second surface of the first bottom plate, and the electronic component of the at least part of the multiple electronic components is partially immersed in the thermal conductive potting layer to conduct heat dissipated by the electronic component to the first heat sink for natural heat dissipation of the electronic component.

The present disclosure further provides a high-power illumination system including the power supply device described above and a light-emitting device electrically connected to the power supply device.

According to the power supply device and the high-power illumination system provided in the present disclosure, the power supply device is provided with a thermal conductive potting layer on a second surface of a first bottom plate, where the thermal conductive potting layer has a certain thickness, and an electronic component on a printed circuit board to be partially immersed into the thermal conductive potting layer, so that heat dissipated by the electronic component is conducted to a first heat sink through the thermal conductive potting layer and the first bottom plate, and finally dissipated into the air, thereby achieving natural heat dissipation of the electronic component and improving the heat dissipation effect. Replacement of the thermal pad with the thermal conductive potting layer can save cost of thermally conductive materials. The cost of the thermal conductive potting layer is only 15% of the cost of the thermal pad with the same volume. Meanwhile, heat conduction is carried out in the form of the thermal conductive potting layer, which does not require pasting and securing per a single piece like the thermal pad, thereby avoiding the problems of misplacing and missing. In addition, a thermal conductive potting layer before curing has a certain viscosity and fluidity, which can match with and attach to surfaces of various electronic components. Therefore, there is no need to separately configure a cooling tank for a specific electronic component with an irregular shape, and standardization and universality can be achieved for the housing of the power supply device, thereby shortening the product development cycle and reducing mold and processing costs.

BRIEF DESCRIPTION OF DRAWINGS

In order to illustrate technical solutions in embodiments of the present disclosure or the prior art more clearly, the accompanying drawings used for description of the embodiments or the prior art will be briefly described hereunder. Obviously, the accompanying drawings in the following description are intended for some embodiments of present disclosure, based on which other drawings may be obtained by persons of ordinary skill in the art without paying any creative effort.

DESCRIPTION OF REFERENCE NUMERALS

Figure 1:
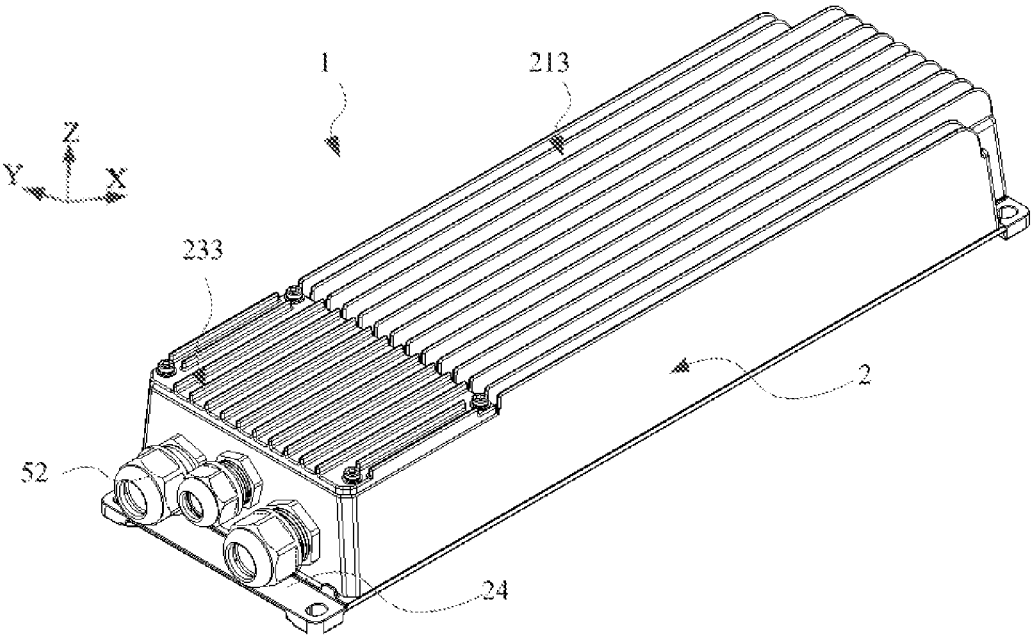
FIG. 1 is a schematic structural view of a power supply device according to an embodiment of the present disclosure.

1—power supply device;

2—housing; 21—first bottom plate; 211—first surface of first bottom plate; 212—second surface of first bottom plate; 213—first heat sink; 214—first connecting column; 215—second connecting column; 22—retaining wall; 23—second bottom plate; 231—first surface of second bottom plate; 232—second surface of second bottom plate; 233—third heat sink; 24—upper cover;

3—thermal conductive potting layer;

4—printed circuit board; 41—circuit board body; 42—electronic component; 421—magnetic component; 422—switch tube;

5—junction box; 51—wiring terminal; 511—input terminal; 512—output terminal; 52—connector;

6—second heat sink; 61—longitudinal part; 62—horizontal part;

7—insulating component; 71—first insulator; 72—second insulator; and

8—high-power illumination system; 81—light-emitting device.

DESCRIPTION OF EMBODIMENTS

Natural heat dissipation is a heat dissipation approach that conduct the heat from a heat source inside a power supply to the housing of the power supply, and then dissipate the heat to the outside of the power supply through natural convection. In the prior art, there are two approaches to conduct the heat inside a high-power supply to the housing of the power supply. A first approach is to provide a thermal pad between an electronic component and the housing, so that the heat of the electronic component is transferred to the housing through the thermal pad to achieve heat dissipation. A second approach is to conduct heat dissipation by configuring a separate cooling tank and potting thermal adhesive in the cooling tanking for an electronic component with a local irregular shape, such as a toroidal inductor in a magnetic component, so that the heat of the electronic component can be transferred to the housing through the thermal adhesive to achieve heat dissipation. However, high-power supply products are complex and have large power losses. When the first approach is adopted, a large number of thermal pads are required, resulting in higher material costs; moreover, in a production line for actual assembly, it is inevitable that there will be a manufacturing risk of misplacing and missing, which is troublesome to actual production. When the second approach is adopted, a space should be reserved for arrangement of a potting area during layout design of a printed circuit board, increasing the size of the product; moreover, for different power supplies, electronic components requiring local potting have different sizes and positions, resulting in a failure of housing standardization and increasing the development cycle and mold costs of the products.

In order to solve the aforementioned technical problem, the present disclosure provides a power supply device and a high-power illumination system, which allows a thermal conductive potting layer to be arranged on a second surface of a first bottom plate and an electronic component on a printed circuit board to be partially immersed into the thermal conductive potting layer, so that heat dissipated by the electronic component is conducted to a first heat sink through the thermal conductive potting layer and the first bottom plate, thereby achieving natural heat dissipation of the electronic component. Replacement of the thermal pad with the thermal conductive potting layer can save cost of thermally conductive materials, and the cost of the thermal conductive potting layer is only 15% of the cost of the thermal pad with the same volume and meanwhile it avoids misplacing and missing of the thermal pad. In addition, the thermal conductive potting layer in the present disclosure can be matched with electronic components on the printed circuit board, therefore, there is no need to arrange a separate cooling tank for an electronic component with an irregular shape on the printed circuit board, and there is no need to adjust the housing and the bottom plates of the power supply according to sizes and positions of different electronic components, so that standardization would be achieved for the housing of the power supply device, thereby shortening the product development cycle and reducing mold and processing costs.

In the description of the present disclosure, it should be noted that, unless explicitly stated and defined otherwise, the terms such as "installed", "coupled", "connected" shall be understood broadly, e.g., they may indicate a secured connection, an indirect connection via an intermediate medium, a communication within two elements and an interaction between two elements. For those of ordinary skill in the art, specific meanings of the above terms in the present disclosure can be understood according to particular cases.

In the description of the present disclosure, it will be appreciated that the orientational or positional relationship indicated by the terms such as "upper", "lower", "front", "rear", "vertical", "horizontal", "top", "bottom", "inside", "outside" and others is an orientational or positional relationship shown based on the drawings, which is only intended for facilitating description of the present disclosure and simplifying the description, rather than indicating or implying that a device or an element indicated must have a specific orientation or be constructed and operated in the specific orientation, thus it cannot be interpreted as a limitation to the present disclosure.

The terms such as "first", "second" and "third" (if any) in the specification and the claims as well as the described accompany drawings of the present disclosure are used to distinguish similar objects, but not intended to describe a specific order or sequence. It will be appreciated that the data used in this way may be exchangeable under appropriate circumstances, such that the embodiments of the present disclosure described herein can be implemented in an order other than those illustrated or described herein, for instance.

Moreover, the terms such as "include" and "have" and any variation thereof are intended to cover a non-exclusive inclusion, e.g., processes, methods, systems, products or maintenance tools that encompass a series of steps or units are not necessarily limited to those steps or units that are explicitly listed, but may include other steps or units that are not explicitly listed or inherent to these processes, methods, products or maintenance tools.

In order to illustrate objectives, technical solutions and advantages of embodiments of the present disclosure more clearly, the technical solutions in the embodiments of the present disclosure will be described hereunder clearly and comprehensively with reference to the accompanying drawings in the embodiments of the present disclosure. Apparently, the described embodiments are only a part of embodiments of the present disclosure, rather than all embodiments of the present disclosure. All other embodiments obtained by persons of ordinary skill in the art based on the embodiments of the present disclosure without paying any creative effort shall fall into the protection scope of the present disclosure.

Figure 2:
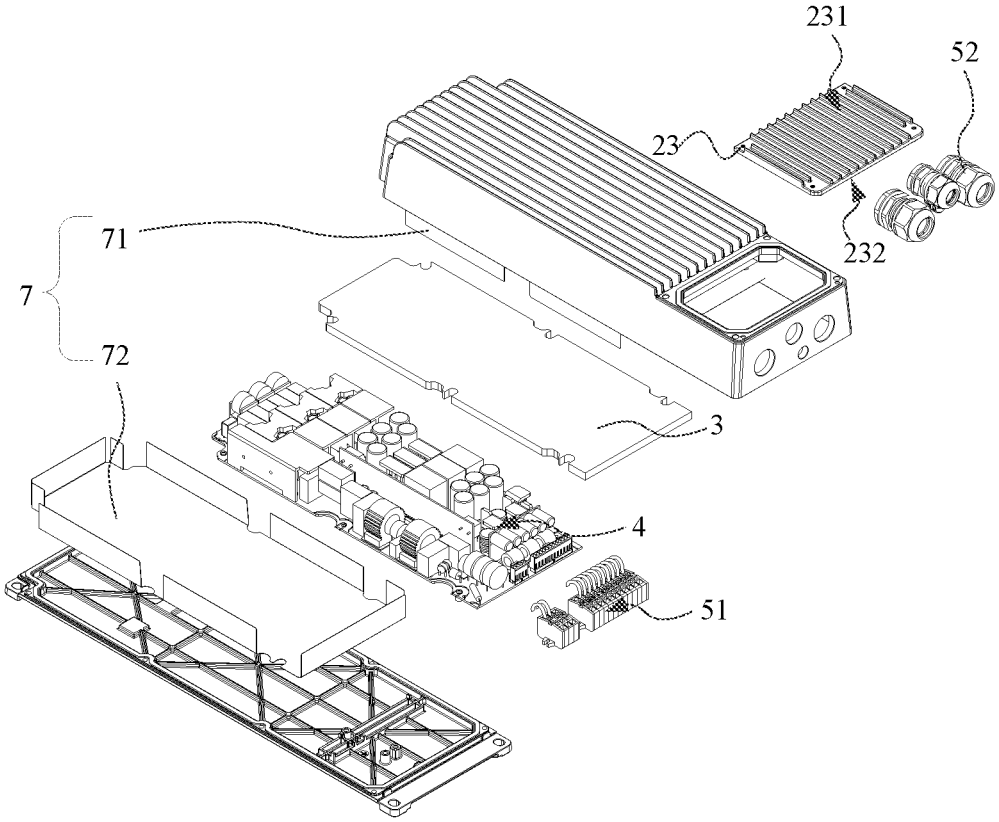
FIG. 2 is an exploded view of the power supply device according to an embodiment of the present disclosure.
Figure 3:
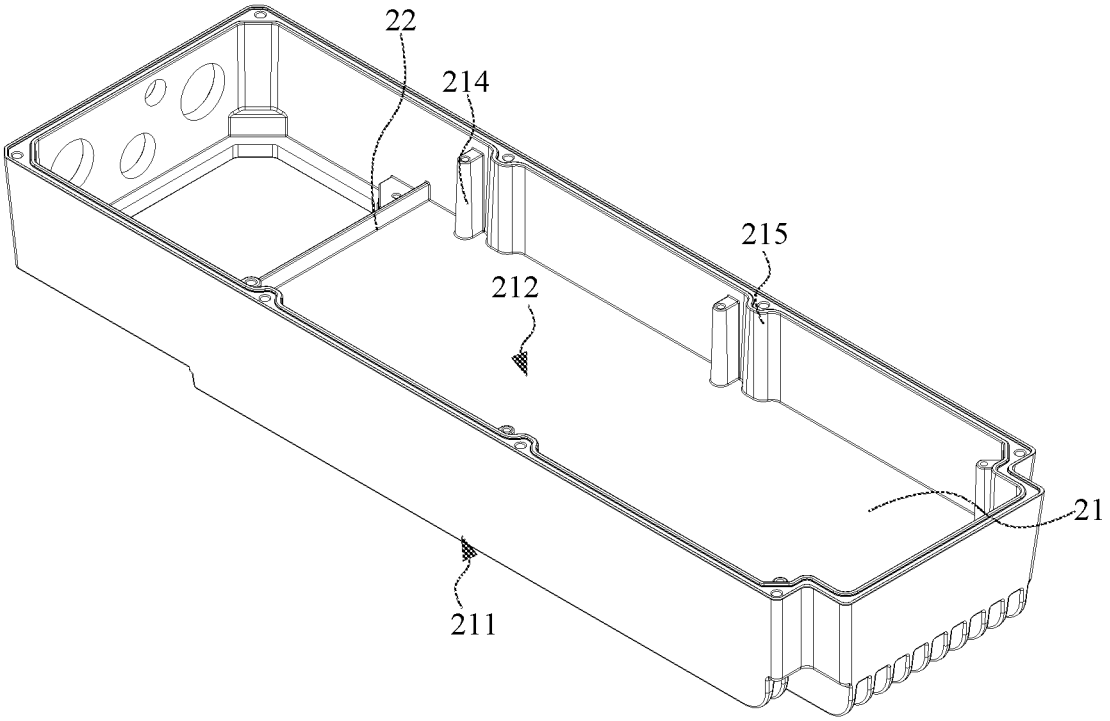
FIG. 3 is a schematic structural view of a first bottom plate in the power supply device according to an embodiment of the present disclosure.
Figure 4:
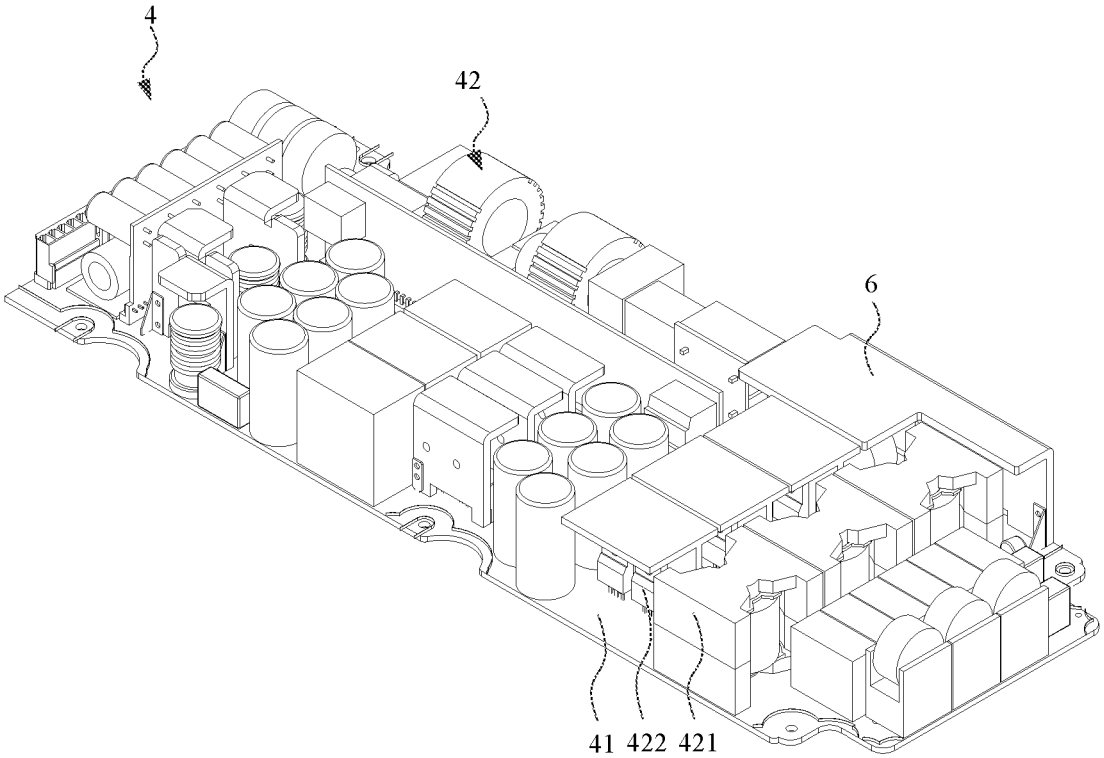
FIG. 4 is a schematic structural view of a printed circuit board in the power supply device according to an embodiment of the present disclosure.

FIG. 1 is a schematic structural view of a power supply device according to an embodiment of the present disclosure; FIG. 2 is an exploded view of the power supply device according to an embodiment of the present disclosure; FIG. 3 is a schematic structural view of a first bottom plate in the power supply device according to an embodiment of the present disclosure; and FIG. 4 is a schematic structural view of a printed circuit board in the power supply device according to an embodiment of the present disclosure. With reference to FIG. 1 to FIG. 4, a power supply device 1 provided in the present disclosure includes a housing 2, where the housing 2 includes a first bottom plate 21 having a first surface (that is, a first surface 211 of the first bottom plate 21) on which a first heat sink 213 is provided and a second surface (a second surface 212 of the first bottom plate 21) on which a thermal conductive potting layer 3 is provided; and a printed circuit board 4, where the printed circuit board 4 is located in the housing 2, the printed circuit board 4 includes a circuit board body 41 and multiple electronic components arranged on the circuit board body 41, at least part of the multiple electronic components (i.e. an electronic component 42) is arranged facing the second surface 212 of the first bottom plate 21, and the electronic component 42 of the at least part of the multiple electronic components is partially immersed in the thermal conductive potting layer 3 to conduct heat dissipated by the electronic component 42 to the first heat sink 213 for natural heat dissipation of the electronic component 42.

In a specific implementation, the housing 2 includes a first bottom plate 21 and side plates sequentially surrounding the first bottom plate 21. The housing 2 is a rectangular housing with an accommodating cavity. The second surface 212 of the first bottom plate 21 and the inner side surfaces of the side plates form the accommodating cavity of the housing 2. The first surface 211 of the first bottom plate 21 is opposed to the second surface 212 of the first bottom plate 21. The thermal conductive potting layer 3 with a uniform thickness is formed on the second surface 212 of the first bottom plate 21 by potting adhesive into the accommodating cavity of the housing 2. The printed circuit board 4 is located in the accommodating cavity of the housing 2.

The printed circuit board 4 may be a double-sided board or a single-sided board. The printed circuit board 4 is flipped facing the second side 212 of the first bottom plate 21 during installation of the printed circuit board 4, so that one side of the printed circuit board 4 on which a high-power electronic component 42 is installed faces the thermal conductive potting layer 3 to enable the electronic component 42 to be partially immersed in the thermal conductive potting layer 3. The high-power electronic component 42 may include, for example, a magnetic component 421 or a switch tube 422.

In order to save time and improve production efficiency, the electronic component 42 is partially immersed into the thermal conductive potting layer 3, and then the thermal conductive potting layer 3 is performed with curing using an oven; after the thermal conductive potting layer 3 is cured, the power supply device 1 is subjected to an aging test to ensure product quality. Understandably, after the thermal conductive potting layer 3 is cured, the power supply device 1 can be directly subjected to the aging test, thereby reducing the transit time.

In order to achieve standardization of the housing 2 and reduce the overall size of the housing 2, before the thermal conductive potting layer 3 is cured, the electronic component 42 on the printed circuit board 4 is pressed downward onto the thermal conductive potting layer 3. Since thermal adhesive has a certain viscosity and fluidity, the shape of the thermal conductive potting layer 3 can be matched with and attached to the shape of the electronic component 42. Therefore, there is no need to adjust the potting position due to different installation positions and sizes of electronic components 42 on different printed circuit boards 4. Hence, standardization is achieved for the housing 2 of the power supply device 1, thereby reducing the product development cycle and mold cost.

Understandably, the first heat sink 213, for example, comprises multiple first heat sink fins connected to the first surface 211 of the first bottom plate 21, and multiple first heat sink fins are spaced apart. In a specific implementation, the first heat sink 213 may be integrally formed with the first bottom plate 21, or the first heat sink 213 may be a separate heat sink connected to the first surface 211 of the first bottom plate 21. Therefore, the heat dissipated by the electronic component 42 is transferred to the first bottom plate 21 through the thermal conductive potting layer 3, and is dissipated into the air through the first heat sink 213 on the first bottom plate 21, thereby achieving heat dissipation of the electronic component 42.

The power supply device 1 provided in the present disclosure allows a thermal conductive potting layer 3 to be arranged on a second surface 212 of a first bottom plate 21, and an electronic component 42 on a printed circuit board 4 to be partially immersed into the thermal conductive potting layer 3, so that heat dissipated by the electronic component 42 is conducted to a first heat sink 213 through the thermal conductive potting layer 3 and the first bottom plate 21, thereby achieving natural heat dissipation of the electronic component 42 and improving the heat dissipation effect. Replacement of the thermal pad with the thermal conductive potting layer 3 saves cost. The cost of the thermal conductive potting layer 3 is only 15% of the cost of the thermal pad with the same volume. Meanwhile, heat conduction is carried out in the form of the thermal conductive potting layer 3, which does not require pasting per a single piece like the thermal pad, thereby avoiding the problems of misplacing and missing.

Figure 5:
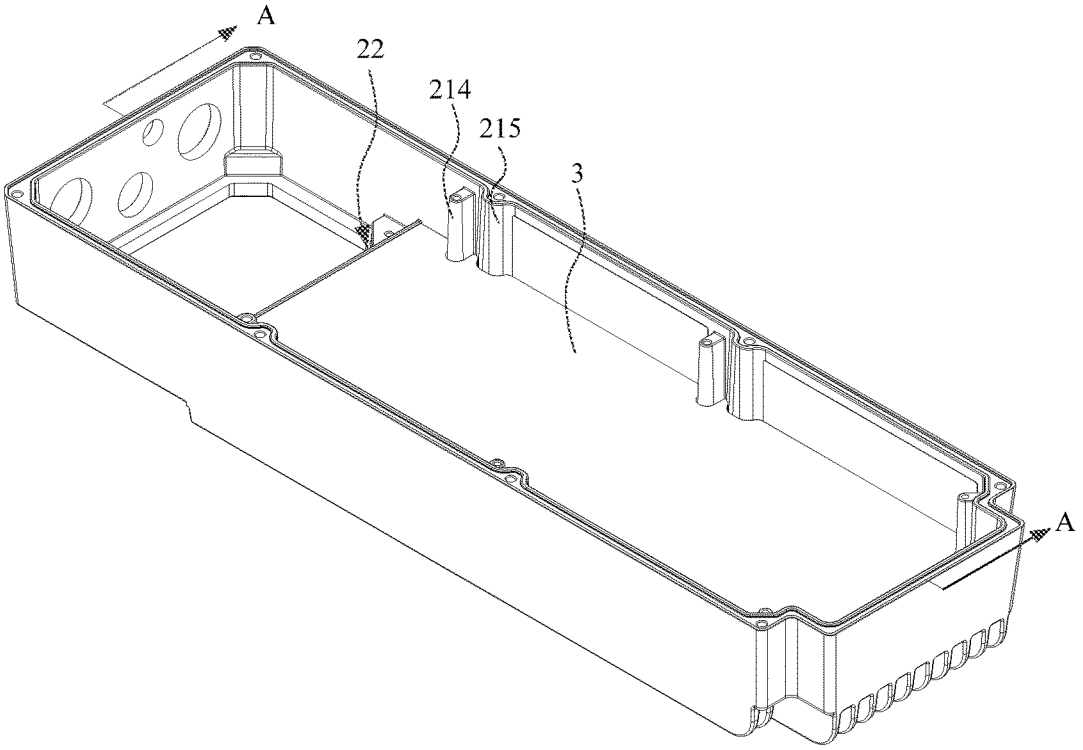
FIG. 5 is a schematic structural view of a thermal conductive potting layer in the power supply device according to an embodiment of the present disclosure.
Figure 6:
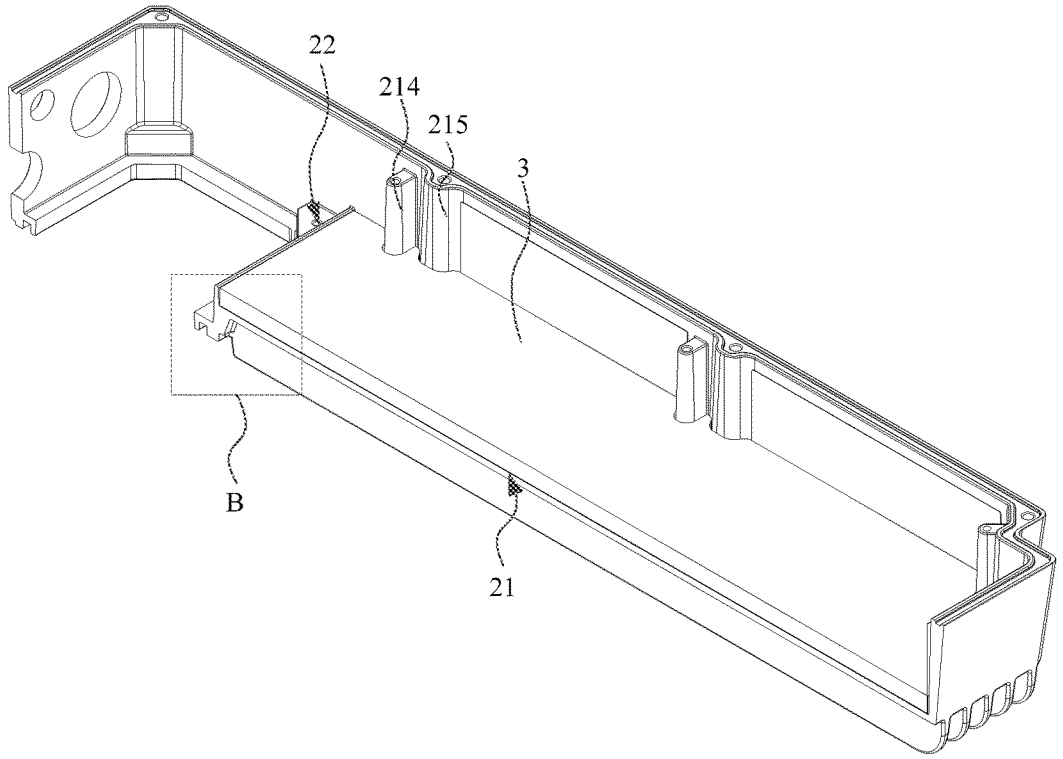
FIG. 6 is a schematic view of a structure cut along the A-A section in FIG. 5.
Figure 7:
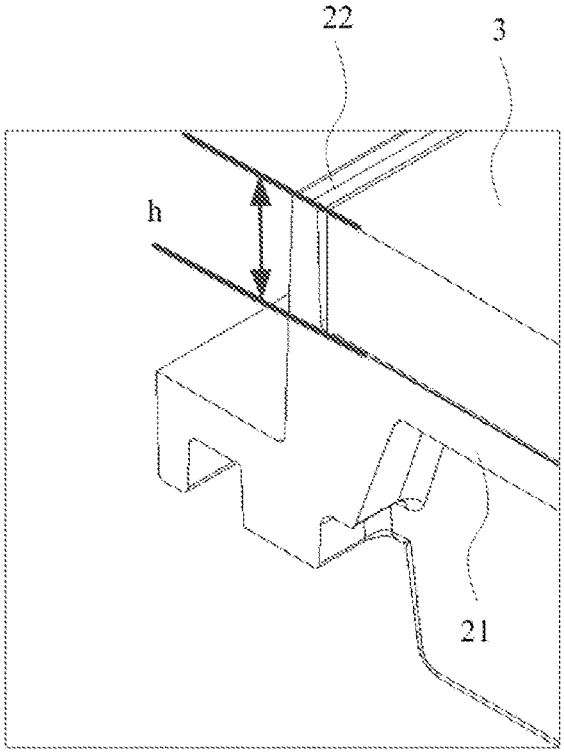
FIG. 7 is a locally enlarged view at B in FIG. 6.

FIG. 5 is a schematic structural view of the thermal conductive potting layer in the power supply device according to an embodiment of the present disclosure; FIG. 6 is a schematic view of a structure cut along the A-A section in FIG. 5; and FIG. 7 is a locally enlarged view at B in FIG. 6. With reference to FIG. 5 to FIG. 7, in order to ensure the heat dissipation effect, the thickness of the thermal conductive potting layer 3 may be set to 5 mm-10 mm, and the thickness of the thermal conductive potting layer 3 should first ensure impregnation of the electronic component 42, for example, but not limited to infiltration into the position of the coil or the wire package of the magnetic component 421 of the electronic component 42, in addition, the operability in the manufacturing process should also be considered. Exemplarily, the thermal conductive potting layer 3 may have a thickness of 6 mm or 8 mm.

Understandably, the thermal adhesive has a certain viscosity and a slightly poor fluidity. When the thickness of the thermal conductive potting layer 3 is set too thin, for example, less than 5 mm, the thickness of various positions of the thermal conductive potting layer 3 is likely to be uneven. Moreover, the height of the electronic component 42 may exceed a design value due to production or installation errors, thus when the thickness of the thermal conductive potting layer 3 is set too thin, the top of the electronic component 42 is likely to directly contact or interfere with the first bottom plate 21 during impregnation. When the thickness of the thermal conductive potting layer 3 is set too thick, for example, greater than 10 mm, the overall weight of the power supply device 1 will increase, and the cost will increase.

Please continue to refer to FIG. 1, in this embodiment, a upper part of the first heat sink 213 is provided as a first heat sink fin. With the first heat sink fin, the surface area of the first heat sink 213 is enlarged, thereby improving the heat dissipation performance of the first heat sink 213. The length direction of the first heat sink fin is consistent with the length direction of the first bottom plate 21, that is, along the X-axis direction in FIG. 1, and the extension direction of the first heat sink fin is consistent with the Z-axis direction in FIG. 1.

With reference to FIG. 3 and FIG. 5 to FIG. 7, in some embodiments, the housing 2 further includes a retaining wall 22 extending upward from the first bottom plate 21, and the retaining wall 22 is used to limit the thermal conductive potting layer 3 on the first bottom plate 21. The bottom plate of the housing 2 may be divided into two areas by the retaining wall 22 so as to limit the thermal conductive potting layer 3 at a position where the first bottom plate 21 just faces the printed circuit board 4.

Understandably, in order to form the thermal conductive potting layer 3, a height h of the retaining wall 22 is greater than or equal to the thickness of the thermal conductive potting layer 3.

Figure 8:
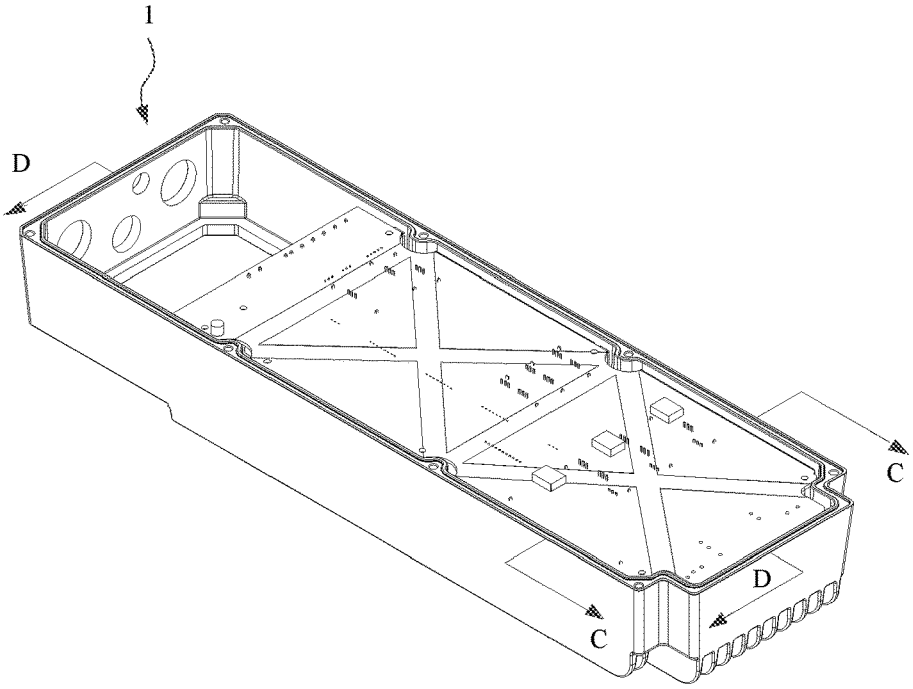
FIG. 8 is a schematic structural view of the power supply device without an upper cover being installed according to an embodiment of the present disclosure.
Figure 9:
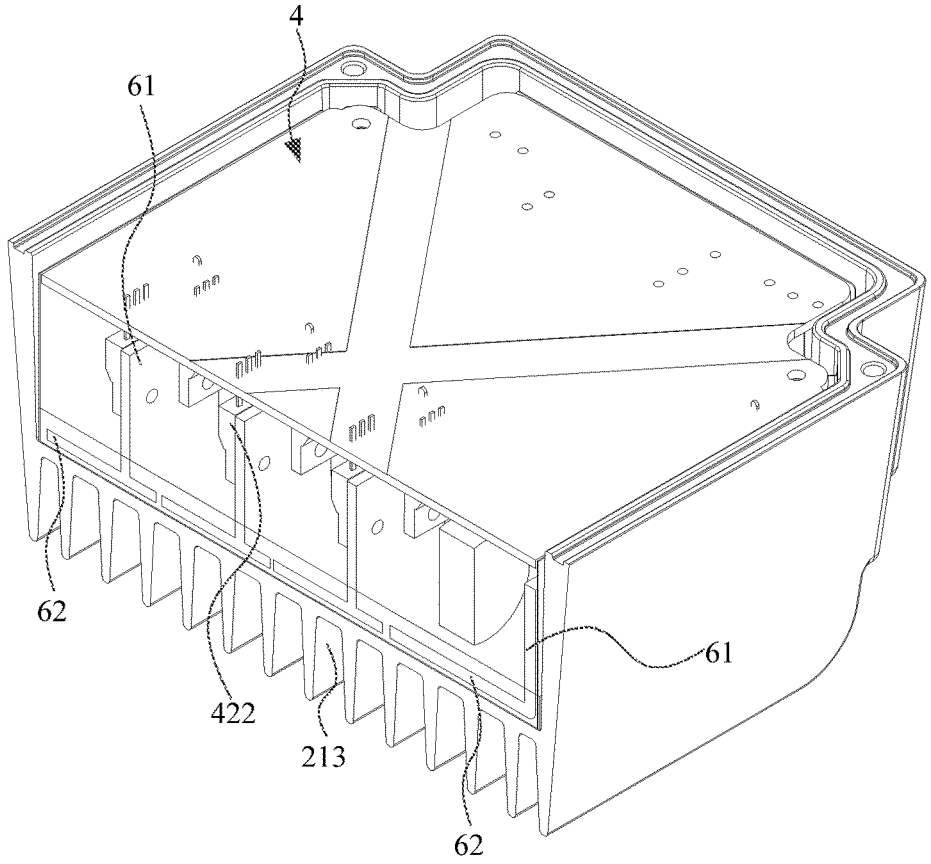
FIG. 9 is a schematic view of a structure cut along the C-C section in FIG. 8.
Figure 10:
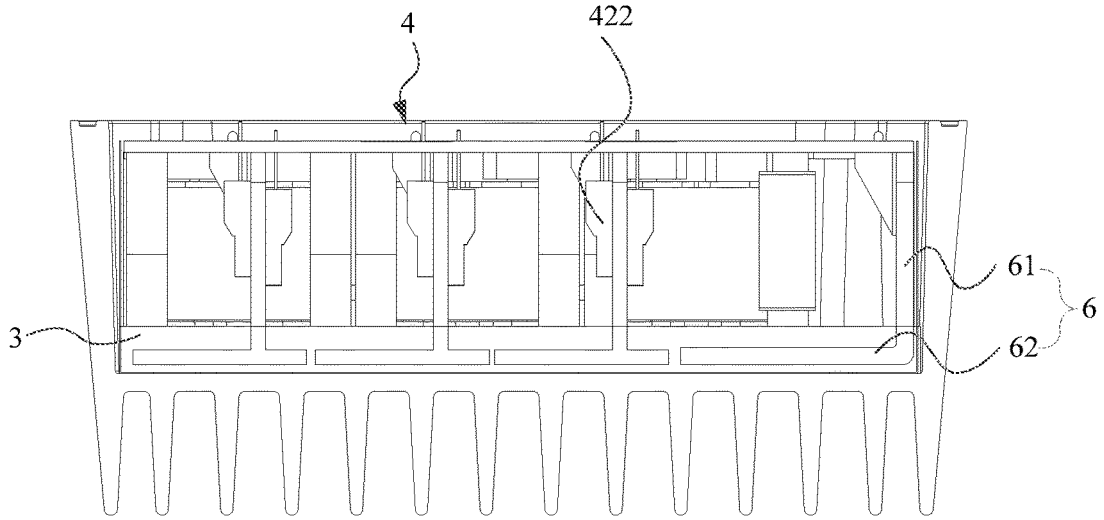
FIG. 10 is a left side view of FIG. 9.
Figure 11:
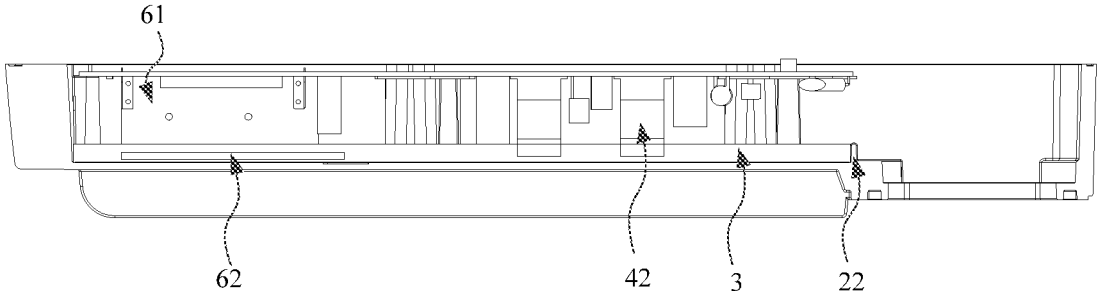
FIG. 11 is a cross-sectional view along the D-D section in FIG. 8.

FIG. 8 is a schematic structural view of the power supply device without an upper cover being installed according to an embodiment of the present disclosure; FIG. 9 is a schematic view of a structure cut along the C-C section in FIG. 8; FIG. 10 is a left side view of FIG. 9; and FIG. 11 is a cross-sectional view along the D-D section in FIG. 8. Please continue to refer to FIG. 4 and FIG. 8 to FIG. 11, in this embodiment, the power supply device further includes a second heat sink 6, where the second heat sink 6 is located between the circuit board body 41 and the first bottom plate 21, and the second heat sink 6 is at least partially immersed in the thermal conductive potting layer 3. The second heat sink 6 is connected to both the circuit board body 41 of the printed circuit board 4 and the electronic component 42, and is in contact with the thermal conductive potting layer 3. The second heat sink 42 may accelerate the transfer of heat from the printed circuit board 4 to the thermal conductive potting layer 3, thereby improving the heat dissipation effect.

Please continue to refer to FIG. 1 and FIG. 4, the electronic component includes multiple magnetic components 421 which have a same extension height in an extension direction of the first heat sink fin. As shown in FIG. 1, the extension direction of the first heat sink fin is the Z-axis direction in FIG. 1. The magnetic components 421 are set to a uniform height, which is conducive to unified design of the housing 2 and favorable to standardization of the housing 2, whereby it is possible to ensure that depths at which the respective magnetic components 421 are immersed in the thermal conductive potting layer 3 are the same so as to avoid interference with the housing 2.

In a specific implementation, please continue to refer to FIG. 4 and FIG. 8 to FIG. 11, the electronic component 42 further includes a switch tube 422 erected on the circuit board body 41, and the second heat sink 6 has a longitudinal portion 61 and a horizontal portion 62. The cross section of the second heat sink 6 may be L-shaped or T-shaped. The switch tube 422 may be secured to the longitudinal portion 61 of the second heat sink 6, so that the surface of the longitudinal portion 61 of the second heat sink 6 is at least partially in contact with the switch tube 422, and the horizontal portion 62 of the second heat sink 6 is immersed in the thermal conductive potting layer 3 for heat dissipation of the switch tube 422. With the arrangement of the second heat sink 6, the heat of the switch tube 422 can be transferred to the thermal conductive potting layer 3, and the heat dissipation of the switch tube 422 can be accelerated. Meanwhile, it is understandable that the height of the second heat sink 6 may be matched with the heights of the magnetic components 421, and the depths at which each of the magnetic components 421 and the second heat sink 6 are immersed in the thermal conductive potting layer 3 are the same, thereby conducive to the design of the housing 2 and favorable to the standardization of the housing 2.

Please continue to refer to FIG. 2, the housing 2 further includes a second bottom plate 23 collocated with the first bottom plate 21, the second bottom plate 23 is securely connected to the housing 2 by screws, the second bottom plate 23 has a first surface (that is, a first surface 231 of the second bottom plate 23) and a second surface (that is, a second surface 232 of the second bottom plate 23), and a third heat sink 233 is provided on the first surface 231 of the second bottom plate 23. The third heat sink 233 may be integrally formed with the second bottom plate 23 or may be a separate heat sink connected to the first surface 231 of the second bottom plate 23.

Figure 12:
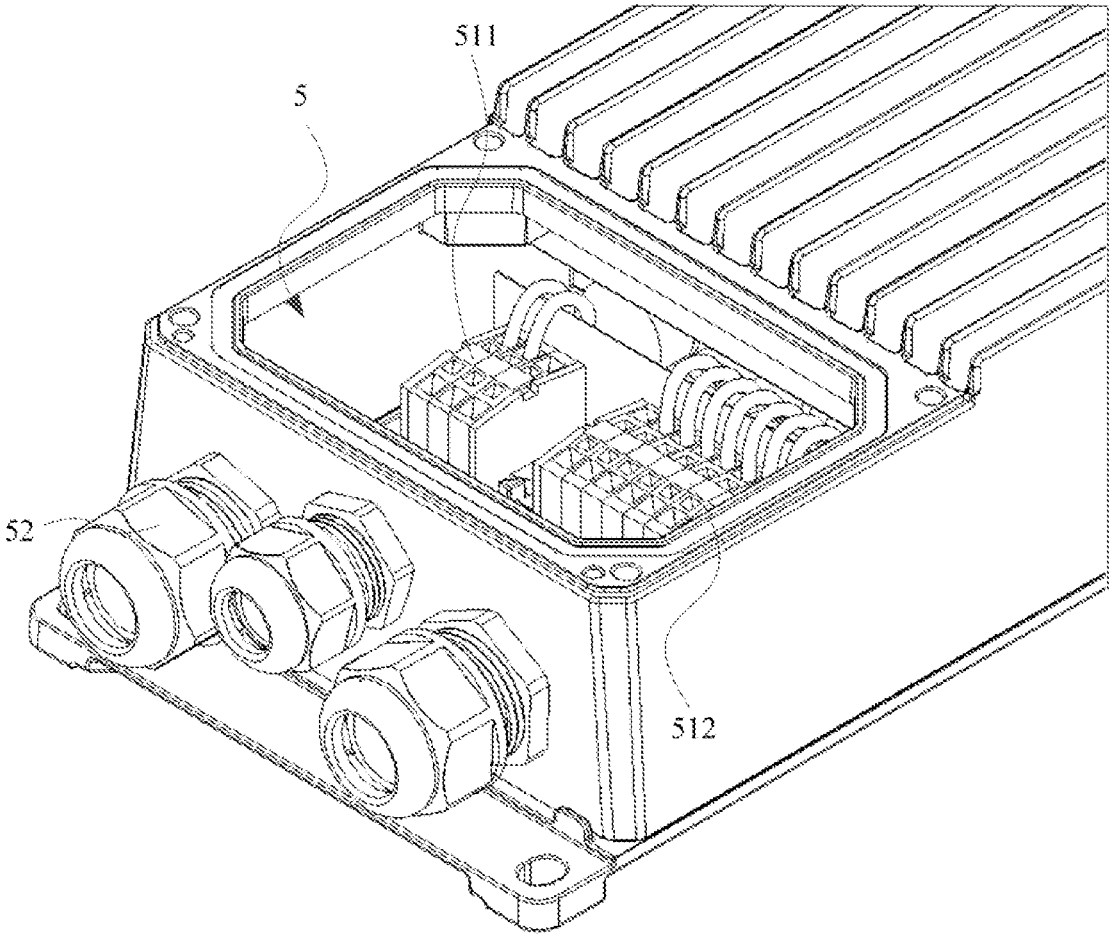
FIG. 12 is a schematic structural view of a junction box in the power supply device according to an embodiment of the present disclosure.

FIG. 12 is a schematic structural view of a junction box in the power supply device according to an embodiment of the present disclosure. With reference to FIG. 2 and FIG. 12, in this embodiment, the power supply device 1 further includes a junction box 5, where the junction box 5 is located in the housing 2, the junction box 5 is arranged facing the second surface 232 of the second bottom plate 23, and the junction box 5 further includes a wiring terminal 51 configured as an input terminal 511 and an output terminal 512 of the power supply device 1. There is a connector 52 on a sidewall of the housing 2, and the connector 52 is opposite to the wiring terminal 51 and is electrically connected to the wiring terminal 51.

Please continue to refer to FIG. 3 and FIG. 5 to FIG. 7. In a specific implementation, the bottom plate of the housing 2 is divided into two areas by the retaining wall 22, that is, two accommodating spaces are formed. The space in the housing 2 facing the first bottom plate 21 is used to accommodate the printed circuit board 4, the retaining wall 22 is used to prevent the thermal conductive potting layer 3 on the first bottom plate 21 from overflowing, and the space in the housing 2 facing the second bottom plate 23 is used to accommodate the junction box 5.

The height h of the retaining wall 22 is 5 mm to 10 mm, exemplarily, the height h of the retaining wall 22 may be 7 mm or 8 mm. Understandably, the height h of the retaining wall 22 should be set to no less than the height of the thermal conductive potting layer 3, but it should not be excessively high. If the retaining wall 22 is excessively high, not only the connection of the printed circuit board 4 with the input terminal 511 and the output terminal 512 of the wiring terminal 51 is affected, but also an extra weight is added to the power supply device 1.

Understandably, in order to facilitate IN-OUT of the wiring terminal 51 in the junction box 5 for wiring operations and subsequent maintenance, the housing 2 includes a second bottom plate 23 collocated with the first bottom plate 21; screw holes may be provided at the joint of the first bottom plate 21 and the second bottom plate 23; and the second bottom plate 23 is overlaid on the joint by, for example, screws, so that the junction box 5 is closed. Certainly, the first bottom plate 21 and the second bottom plate 23 may also be securely connected by other locking devices, and the present disclosure is not limited thereto.

Please continue to refer to FIG. 1, in order to expand the heat dissipation area and improve the heat dissipation effect, the third heat sink 233 comprises a second heat sink fin. The second heat sink fin has the same shape as the first heat sink fin, and respective fins are aligned with each other to form a continuous channel between the fins, which is favorable to the flow of hot air, thereby improving the heat dissipation efficiency of the entire power supply device 1.

Please continue to refer to FIG. 1 to FIG. 3. In a specific implementation, the housing 2 further includes an upper cover 24 arranged opposite to the first bottom plate 21 and connected to sidewalls of the housing 2 by screws. The sidewalls of the housing 2 is provided with a first connecting column 214 and a second connecting column 215 having different heights. In some embodiments, the first connecting column 214 and the second connecting column 215 are multiple in number. The first connecting column 214 and the second connecting column 215 have threaded holes on their ends. The printed circuit board 4 is secured on the first connecting column 214 having a lower height by screws, and the upper cover 24 is connected to the second connecting column 215 having a higher height by screws.

In order to maintain a safe distance between the printed circuit board 4 and the housing 2, and to improve product reliability, an insulating component 7 is provided between the upper cover 24 of the housing 2 and the printed circuit board 4 and between the sidewalls of the housing 2 and the printed circuit board 4.

The insulating component 7 includes multiple first insulators 71 and second insulators 72. The first insulator 71 is arranged between the sidewalls of the housing 2 and the printed circuit board 4. The second insulator 72 includes a bottom plate and extending edges surrounding the bottom plate, where the bottom plate of the second insulator 72 is arranged between the upper cover 24 of the housing 2 and the printed circuit board 4, and the extending edges of the second insulator 72 partially overlaps the first insulator 71. Alternatively, the first insulator 71 has the same shape as the second insulator 72, which includes a bottom plate and extending edges surrounding the bottom plate. The bottom plate of the first insulator 71 is arranged between the first bottom plate 21 and the thermal conductive potting layer 3, and the extending edges of the first insulator 71 are arranged on four sidewalls of the housing 2. The bottom plate of the second insulator 72 is arranged between the upper cover 24 of the housing 2 and the printed circuit board 4, and the extending edges of the second insulator 72 partially overlap the extending edges of the first insulator 71.

Division of the insulating component 7 into the first insulator 71 and the second insulator 72 may be conducive to installation. The first insulator 71 partially overlaps the second insulator 72 to avoid generation of a gap at the connection between the first insulator 71 and the second insulator 72, thereby ensuring a complete isolation between the printed circuit board 4 and the housing 2.

Exemplarily, the first insulator 71 and the second insulator 72 may be Mylar sheets. The Mylar sheets have dimensional stability, straightness, excellent tear resistance, heat and cold resistance, moisture resistance, water resistance, and chemical corrosion resistance, and have superior insulation property as well as excellent electrical, mechanical, heat-resistant, and chemical-resistant property.

Figure 13:
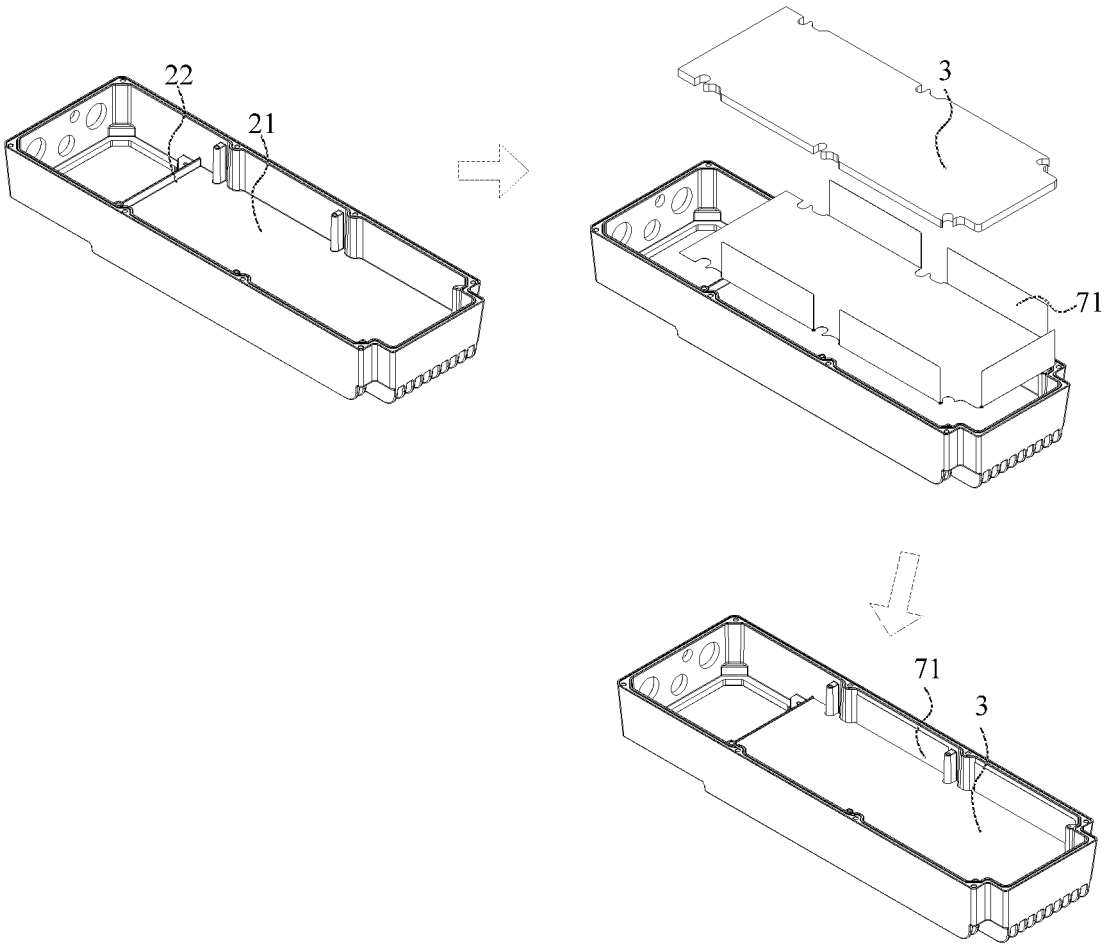
FIG. 13 is a schematic view illustrating an operation for potting step to form the thermal conductive potting layer of the power supply device according to an embodiment of the present disclosure.
Figure 14:
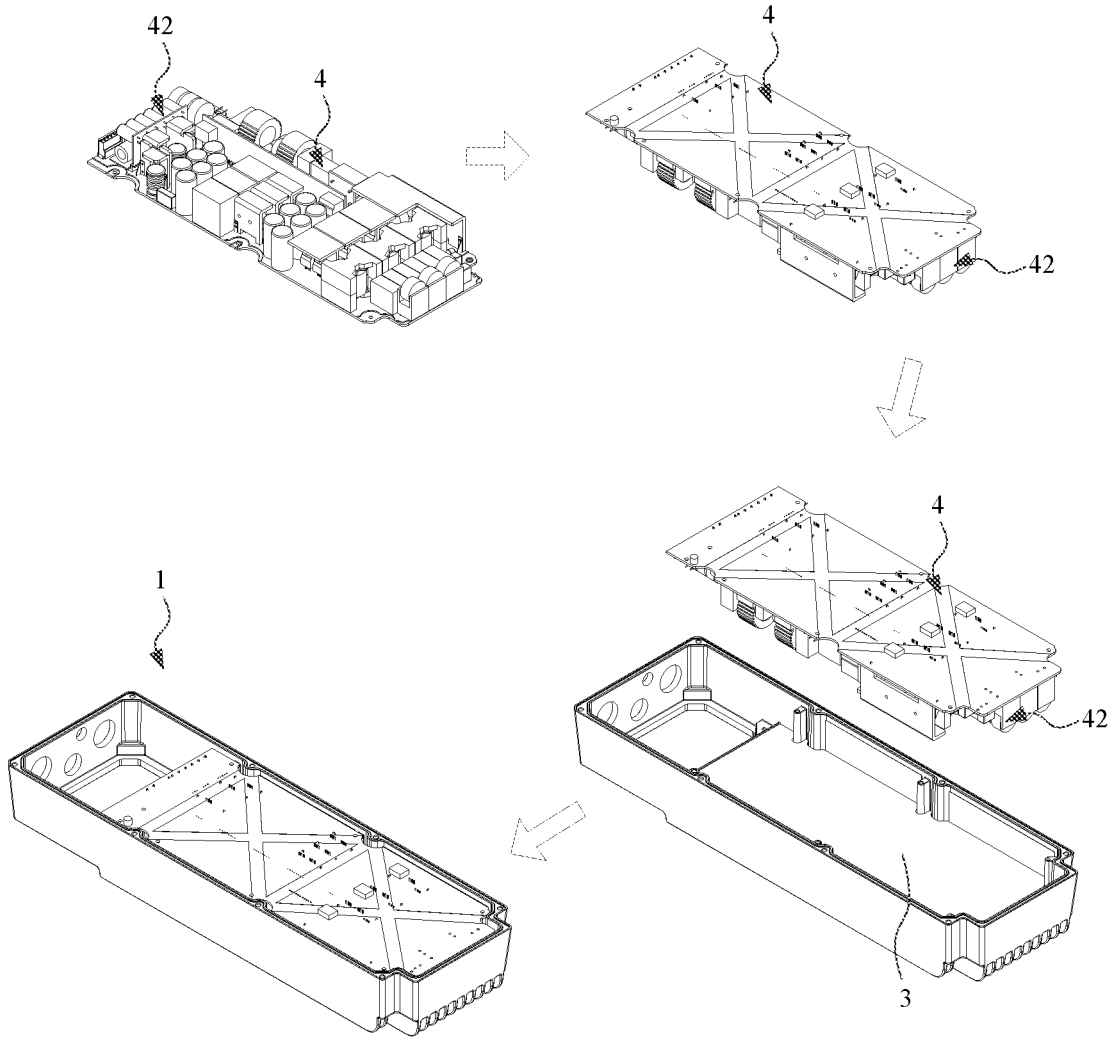
FIG. 14 is a schematic view illustrating an operation for flipping and impregnation step for the printed circuit board of the power supply device according to an embodiment of the present disclosure.

FIG. 13 is a schematic view illustrating an operation for potting step to form the thermal conductive potting layer of the power supply device according to an embodiment of the present disclosure; and FIG. 14 is a schematic view illustrating an operation for flipping and impregnation step for the printed circuit board of the power supply device according to an embodiment of the present disclosure. The main installation steps of the power supply device 1 are described hereunder in conjunction with the drawings.

As shown in FIG. 13, potting adhesive is conducted to form the thermal conductive potting layer 3.

The bottom plate of the first insulator 71 is arranged on the second surface 212 of the first bottom plate 21, the extending edges of the first insulator 71 are arranged on the sidewalls of the housing 2, and potting adhesive is conduced into the area where the first bottom plate 21 is located so as to form the thermal conductive potting layer 3.

As shown in FIG. 14, the printed circuit board 4 is flipped facing the thermal conductive potting layer 3, so that the electronic component 42 is subjected to partial impregnation. The side of the printed circuit board 4 on which the magnetic components 421 and the switch tube 422 are installed is flipped, and the electronic component 42 is partially immersed in the thermal conductive potting layer 3, and the printed circuit board 4 is connected to the first connecting columns 214 using screws, thereby pressing the electronic component 42 on the printed circuit board 4 onto the thermal conductive potting layer 3.

Figure 15:
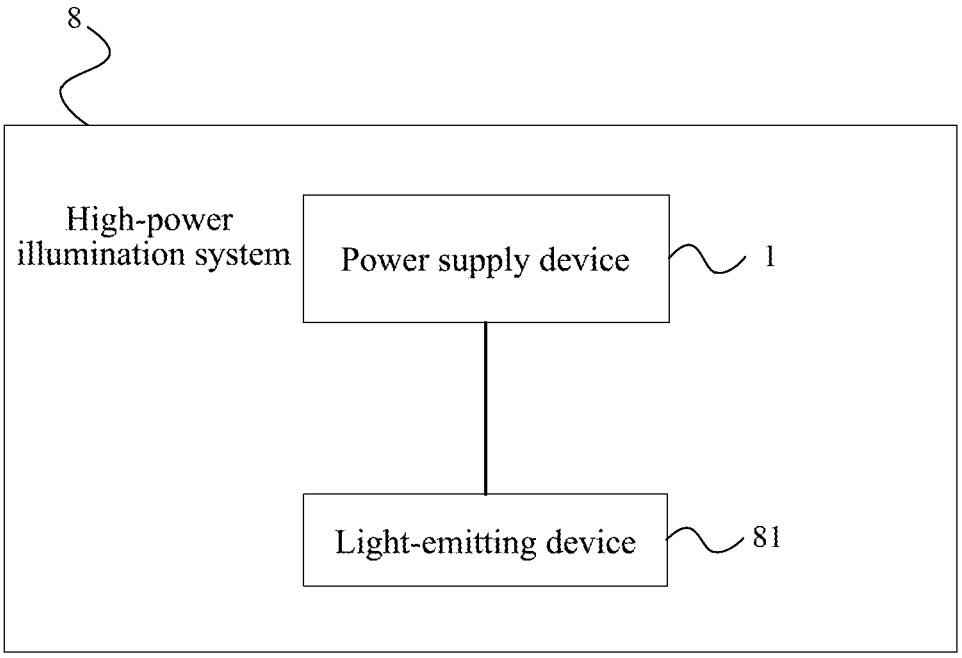
FIG. 15 is a schematic structural view of a high-power illumination system according to an embodiment of the present disclosure.

FIG. 15 is a schematic structural view of a high-power illumination system according to an embodiment of the present disclosure. With reference to FIG. 15, an embodiment of the present disclosure also provides a high-power illumination system 8. The high-power illumination system 8 includes the above-mentioned power supply device 1 and a light-emitting device 81 electrically connected to the power supply device 1. Exemplarily, the high-power illumination system 8 may be an outdoor landscape light, a billboard, and a field illumination system.

The power supply device 1 has been described in detail in the above-mentioned embodiments with regard to its structure and principle, and details will not be described in this embodiment again.

Finally, it should be noted that the foregoing embodiments are merely intended for describing, rather than limiting, the technical solutions of the present disclosure. Although the present disclosure has been described in detail with reference to the foregoing embodiments, persons of ordinary skill in the art should understand that they may still make modifications to the technical solutions described in the foregoing embodiments, or make equivalent replacements to some or all technical features therein; however, these modifications or replacements do not make the essence of corresponding technical solutions depart from the scope of the technical solutions in the embodiments of the present disclosure.

What is claimed is:

1. A power supply device, comprising:

a housing, wherein the housing comprises a first bottom plate having a first surface on which a first heat sink is provided and a second surface on which a thermal conductive potting layer is provided; and a printed circuit board, wherein the printed circuit board is located in the housing, the printed circuit board comprises a circuit board body and multiple electronic components arranged on the circuit board body, at least part of the multiple electronic components is arranged facing the second surface of the first bottom plate, and the electronic component of the at least part of the multiple electronic components is partially immersed in the thermal conductive potting layer to conduct heat dissipated by the electronic component to the first heat sink for natural heat dissipation of the electronic component;

wherein the power supply device further comprises: a second heat sink;

wherein the electronic component of the at least part of the multiple electronic components comprises a switch tube erected on the circuit board body;

and wherein the second heat sink has a longitudinal portion having a surface at least partially in contact with the switch tube and a horizontal portion immersed in the thermal conductive potting layer for heat dissipation of the switch tube.

2. The power supply device according to claim 1, wherein a thickness of the thermal conductive potting layer is 5 mm to 10 mm.

3. The power supply device according to claim 1, wherein the first heat sink comprises a first heat sink fin.

4. The power supply device according to claim 3, wherein the electronic component comprises multiple magnetic components which have a same extension height in an extension direction of the first heat sink fin.

5. The power supply device according to claim 1, wherein the housing further comprises a retaining wall extending upward from the first bottom plate, and the retaining wall is used to limit the thermal conductive potting layer on the first bottom plate.

6. The power supply device according to claim 5, wherein a height of the retaining wall is greater than or equal to the thickness of the thermal conductive potting layer.

7. The power supply device according to claim 6, wherein the height of the retaining wall is 5 mm to 10 mm.

8. The power supply device according to claim 1, wherein the second heat sink is located between the circuit board body and the first bottom plate.

9. The power supply device according to claim 1, wherein the housing further comprises a second bottom plate collocated with the first bottom plate, the second bottom plate is securely connected to the housing by screws, the second bottom plate has a first surface and a second surface, and a third heat sink is provided on the first surface of the second bottom plate.

10. The power supply device according to claim 9, further comprising: a junction box, wherein the junction box is located in the housing, the junction box is arranged facing the second surface of the second bottom plate, and the junction box further comprises a wiring terminal configured as an input terminal and an output terminal of the power supply device.

11. The power supply device according to claim 9, wherein the third heat sink comprises a second heat sink fin.

12. The power supply device according to claim 1, wherein the housing further comprises an upper cover arranged opposite to the first bottom plate and connected to sidewalls of the housing by screws;

and wherein an insulating component is provided between the upper cover of the housing and the printed circuit board and between the sidewall of the housing and the printed circuit board.

13. A high-power illumination system, comprising: the power supply device according to claim 1, and a light-emitting device electrically connected to the power supply device.

* * * * *